US006212867B1

(12) United States Patent
Lorenz

(10) Patent No.: US 6,212,867 B1
(45) Date of Patent: Apr. 10, 2001

(54) FALSE TWIST DEVICE

(75) Inventor: Hellmut Lorenz, Remscheid (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/308,856

(22) PCT Filed: Sep. 22, 1998

(86) PCT No.: PCT/EP98/06028

§ 371 Date: May 26, 1999

§ 102(e) Date: May 26, 1999

(87) PCT Pub. No.: WO99/16949

PCT Pub. Date: Apr. 8, 1999

(30) Foreign Application Priority Data

Sep. 26, 1997 (DE) ..... 197 42 728

(51) Int. Cl.[7] ..... D01H 1/24
(52) U.S. Cl. ..... 57/338; 57/77.4; 57/339
(58) Field of Search ..... 57/338, 77.4, 337, 57/339, 77.45

(56) References Cited

U.S. PATENT DOCUMENTS 3,705,488 * 12/1972 Sholly et al. ..... 57/77.4
3,901,011 8/1975 Schuster .
4,051,655 * 10/1977 Lorenz et al. ..... 57/77.4
4,115,987 * 9/1978 Taniguchi et al. ..... 57/77.4
4,195,470 * 4/1980 Sturhahn ..... 57/339
4,235,071 11/1980 Dillon .
5,349,808 9/1994 Lorenz .

FOREIGN PATENT DOCUMENTS 27 08 204 8/1978 (DE) .
28 12 614 9/1979 (DE) .
0 012 625 6/1980 (EP) .

* cited by examiner

*Primary Examiner*—John J. Calvert
*Assistant Examiner*—Shaun R Hurley
(74) *Attorney, Agent, or Firm*—Alston & Bird LLP

(57) ABSTRACT

The invention relates to a false twist device for a synthetic multifilament yarn for use in false twist texturing machines. The false twist device comprises at least three sets of disks that are each arranged on an axle for rotation in the same direction. The axles are arranged to form an equilateral polygon such that the disks overlap in the center of the polygon. To keep a yarn tension as low as possible at a high yarn speed, the circumferential surface of the disks is the zone of a sphere or a torus with a circumferential surface radius that has a magnitude of at least 35 times the diameter of the twisted yarn.

13 Claims, 3 Drawing Sheets

FALSE TWIST DEVICE

BACKGROUND OF THE INVENTION

The invention relates to a false twist device for a synthetic multifilament yarn for use in false twist texturing machines.

In the case of false twist texturing machines, one starts out from the principle that, while advancing through a false twist device, the synthetic multifilament yarn is put in a twisted condition at, for example, more than 2,000 rpm, and heated in this twisted condition to the plasticization limit. Thereafter, it is again cooled to a temperature that is below the first-order transition point.

To impart a twist, a false twist device is used that is known from U.S. Pat. No. 4,235,071. The false twist device consists of three sets of disks that are each mounted on an axle for rotation in the same direction. The axles are arranged in the corners of an equilateral polygon, so that the disks overlap in the center thereof. In the center of the polygon, the yarn advances through the false twist device. In so doing, the yarn contacts the circumferential surface of the rotating disks, and is thus twisted. Heating and subsequent cooling in the false twist machine set the form predetermined by the twist impartation, so that after untwisting, a crimp remains in the yarn.

In this process, it should be taken into account that currently the false twist texturing machines process yarns of polyester, in particular, polyethylene therephthalate, polyamide 6 (Perlon) or polyamide 6.6 (Nylon). In so doing, the yarns are processed from partially oriented feed yarns. These partially oriented feed yarns are spun at a high speed and, consequently, subjected in the texturing machine only to a small draw ratio of less than 2:1 in the case of polyester, preferably less than 1.8:1 in the case of polyamides, preferably less than 1.3:1.

In this draw process, the polyester yarns are subjected in a heating zone to temperatures from 190° C. to 210° C., nylon yarns from 190° C. to 205° C., and perlon yarns to about 170° C.

The technological requirement that the effective yarn temperature in the heating zone must exceed 180° C., preferably 200° C. results at increasing yarn speeds and with the known cooling devices in that the yarn enters into the false twist device at an overly increased temperature. Upon its entry into the false twist device, the yarn temperature may be greater than 100° C.

The increased yarn advancing speeds during the false twist impartation necessitates higher yarn tensions to obtain a stable texturing process. Such yarn tensions can be realized by increasing the draw ratio, which leads again to undesired changes in the yarn properties (primarily low elongation).

It is therefore the object of the invention to further develop a false twist device of the initially described kind such that within a false twist zone in a false twist texturing machine, a stable yarn advance is realized at yarn speeds greater than 1,000 m/min, in particular above 1,200 m/min.

SUMMARY OF THE INVENTION

In accordance with the invention, a false twist device having the characteristic features of claim 1 accomplishes the object.

The invention is based on the recognition that while maintaining a stable process at an increased yarn speed, the yarn tension will have to be increased to a lesser extent, when the disks of a false twist device have a correspondingly large radius on their circumferential surfaces that are contacted by the yarn. In terms of measurements, one finds a reduction of the coefficient of friction. This is surprising, inasmuch as the radius of the circumferential disk surface—when viewed in the radial section of the disks—is unusually large, so that because the thereby caused lengthening of the contact length of the yarn wetted with a lubricant, one has to expect an increase in the coefficient of friction or the yarn tension (Euler law). In comparison therewith, it can be expected under the Eitelwein law that the coefficient of friction or the yarn tension depends exclusively on the looping angle, but not on the radius or the length of the looped surface. In fact, the reduction of the coefficient of friction or the yarn tension is based on the decreased inner friction in the yarn that is caused by a larger radius of curvature. The inner friction in the yarn results from the alternating bending stress of the yarn inside the false twist device. By increasing the circumferential surface radii, it is possible to reduce these alternating bending stresses accordingly. Since the alternating bending stress of the yarn increases at a smaller yarn diameter, it has shown that in proportion to the diameter dF of the twisted yarn, the radius r of the circumferential surface must have a certain magnitude, which is at least 35 times the diameter $d_F$ of the twisted yarn. In the following "circumferential surface" stands for that surface on the disk that is contacted by the yarn, outer surface for the entire disk surface (without the front ends).

Currently, false twist texturing machines process preferably polyester or polyamide yarns. In this connection, it is preferred to process polyamide yarns with deniers smaller than 170 dtex, and polyester yarns even with deniers greater than 170 dtex. In the case of a textured yarn with a denier greater than 170 dtex, a circumferential surface radius greater than 35 times the diameter of the twisted yarn, accomplishes the above object for processing polyester yarns.

To process polyamide yarns with advantage, the false twist device of the present invention preferably is constructed so that the circumferential surface radius is greater than 40 times the diameter of the twisted yarn.

In a particularly preferred embodiment of the false twist device according to the invention, the circumferential surface radius r is defined in relationship to the disk height h such that the center of the circumferential surface radius lies outside of the center plane of the disk, preferably between the inlet end edge and the center plane of the disk. With that, it is possible to realize, in particular in the case of disks with high coefficients of friction, that the circumferential surface is substantially the same as the outer surface, and that the yarn does not advance over the edges of the front ends. By imparting the twist, the yarn is influenced while looping the disk in such a manner that the yarn contacts the circumferential surface of the disk at a greater angle of slope and leaves the circumferential surface at a smaller angle of slope. Thus, because of the asymmetric configuration of the disk, only a shorter section of the toroidal surface is available on the inlet side than on the outlet side. With this configuration of the false twist devices, which is used preferably for disks of frictionally intensive materials, such as, for example polyurethane or rubber, it is possible to use the disks only in a certain installed position. To avoid installation errors during the assembly, the front ends of such disks are identified (for example, by an imprint annular groove, etc.).

To impart to the yarn, despite the high yarn speed the necessary twist (of, for example, more than 2,000 rpm) while maintaining an adequate process stability, the disks of a preferred further development of the false twist device are made of a heat-resistant elastomer. The heat resistance of the elastomer enables a yarn temperature on the disks greater than 100° C.

In a particularly preferred further development of the invention, the disks consist of a heat-resistant rubber, in particular nitrile-butadiene rubber saturated with hydrogen. This material is especially advantageous, since it is also especially wear-resistant and, moreover, possesses satisfactory frictional properties relative the synthetic multifilament yarns. It is therefore especially suited for processing yarns at high yarn speeds and high temperatures.

BRIEF DESCRIPTION OF THE DRAWINGS

In the following, an embodiment is described with reference to the attached drawings, in which:

FIG. 1 is a schematic view of an embodiment of the false twist device according to the invention. The false twist device could be used, for example, in the texturing machine disclosed in EP 0 641 877, which is herewith incorporated by reference.

DETAILED DESCRIPTION OF THE PREFERRED EMBODIMENTS

Figure 1:
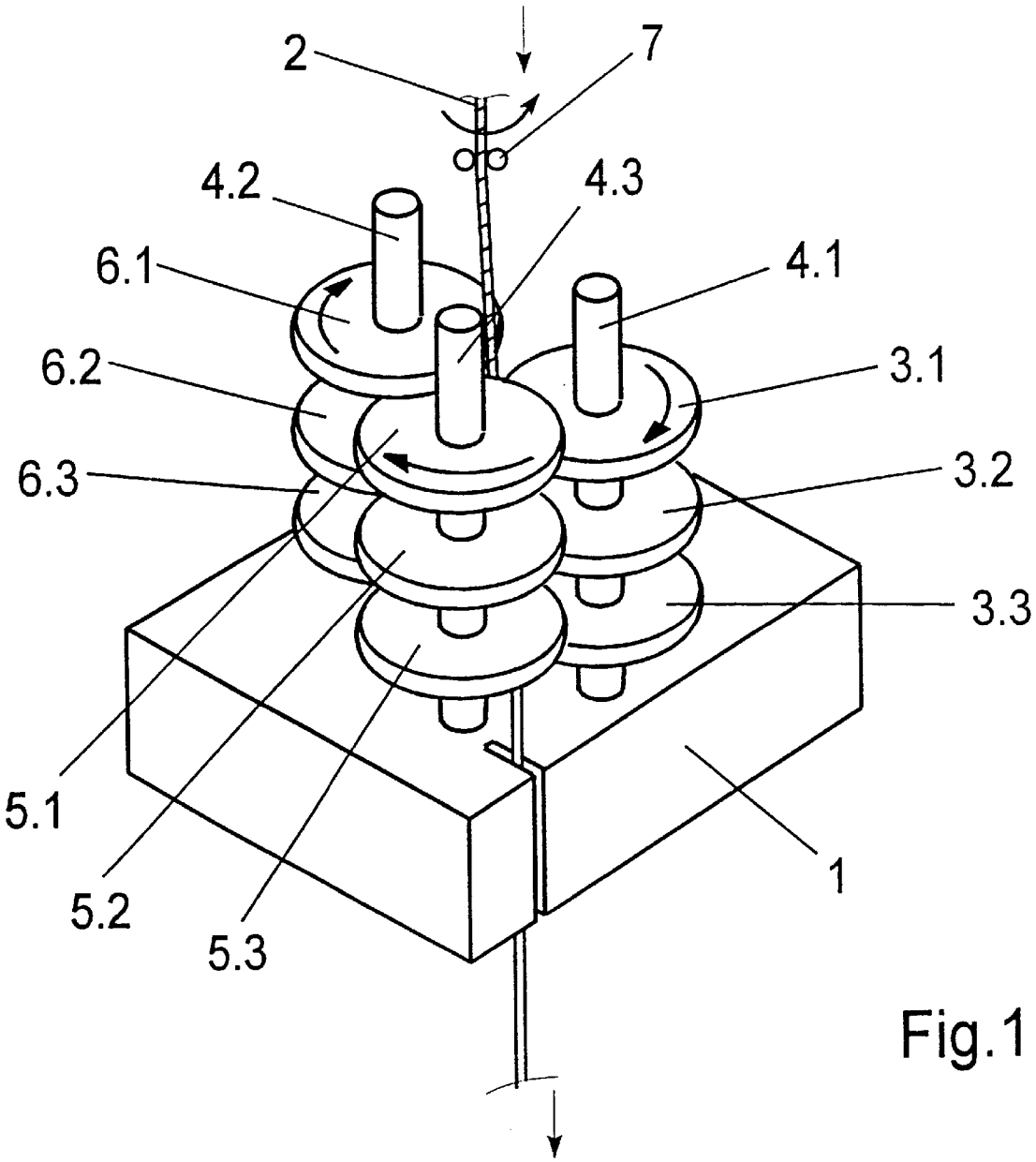
FIG. 1 is a schematic view of a false twist device.

The false twist device consists of three parallel shafts 4.1, 4.2, and 4.3. At their one end (drive end), the shafts 4.1, 4.2, and 4.3 are supported for rotation in a bearing block 1 and arranged in such a manner that the shafts are each located in a comer of an equilateral triangle. The shaft 4.1 supports a set of disks 3 inserted from the free end thereof. The set of disks 3 consists of three spaced-apart, individual disks 3.1, 3.2, and 3.3. The shaft 4.2 mounts a set of disks 6 and shaft 4.3 a set of disks 5. The set of disks 6 and the set of disks 5 consist likewise of respectively three spaced-apart, individual disks. The disks of disk sets 3, 5, and 6 overlap in the center region of the equilateral triangle formed by the shafts. The shafts 4.1, 4.2, and 4.3 connect at the drive end to a drive not shown. The drive rotates the shafts and, thus, the disks of disk sets 3, 5, and 6 in the same direction. The drive could be effected, for example, by a belt drive, as disclosed in EP 0 744 480, which is herewith incorporated by reference.

The number of disks within a set is exemplary. A shaft may also mount more or less disks.

On the inlet side of the false twist device, a yarn guide 7 is arranged. Via yarn guide 7, the yarn enters into the overlapping region located substantially in the region of the center of this equilateral triangle. The yarn then advances helically toward the drive side of the false twist device. In so doing, the yarn loops about the disks of disk sets 3, 5, and 6 on the circumferential surfaces thereof. To this end, the yarn is withdrawn at a predetermined withdrawal speed by a feed system downstream of the false twist device. Thus, the yarn 2 receives a false twist that is set in a false twist zone upstream of the false twist device. To reduce yarn tension losses within the false twist device, the disks have a relatively large radius on their circumferential surface.

Figure 2:
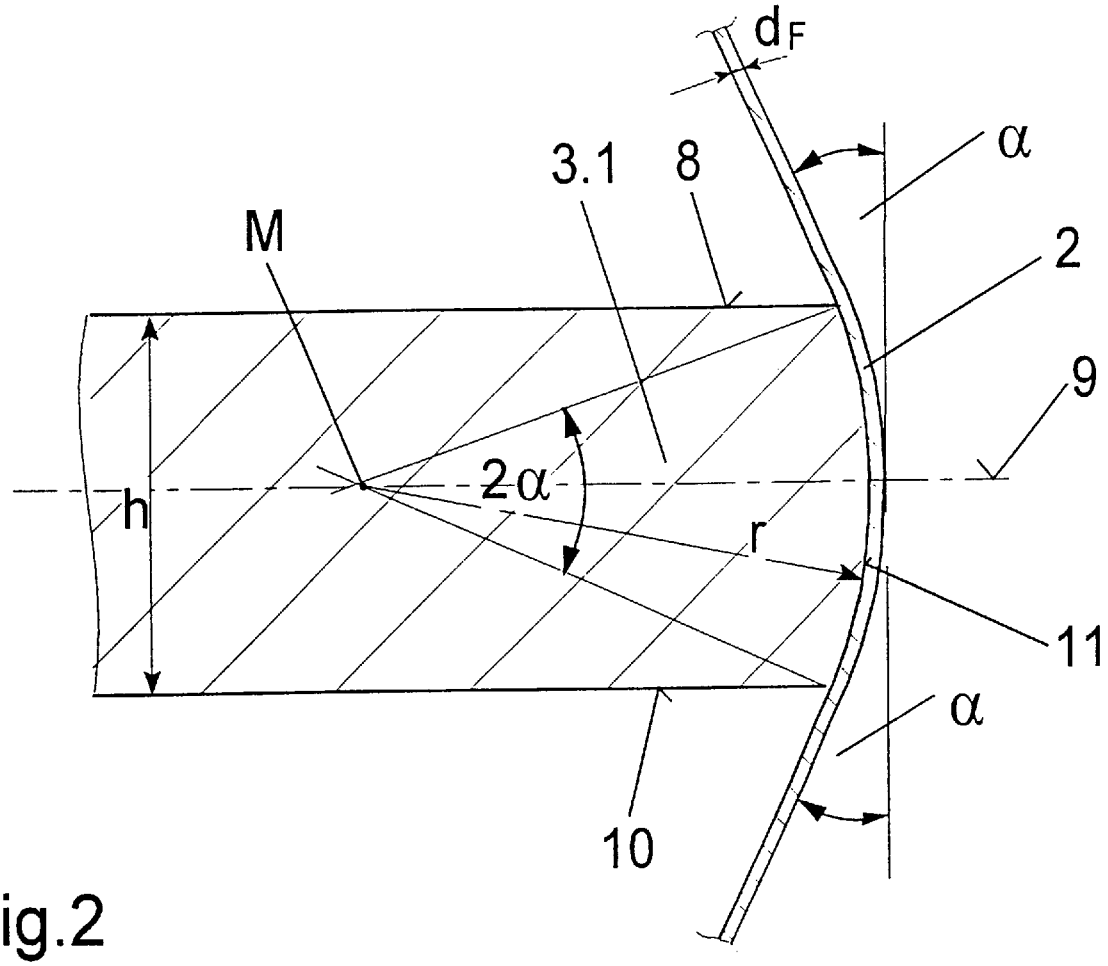
FIGS. 2 and 3 are each a sectional view of the disk of a false twist device, as well as the advance of the yarn over the disk.

As shown in FIG. 2, the circumferential surface of the disk is formed with a constant radius in the same way as the surface of the zone of a sphere or a torus. FIG. 2 is a radially sectioned view of a disk of the false twist device of FIG. 1. In the embodiment of the disk according to the invention, the radius r of circumferential surface 11 is made so large that the entire circumferential surface is uniformly curved in the region of disk height h. FIG. 2 shows by way of example the disk 3.1 of the false twist device shown in FIG. 1. In this example, the disk 3.1 is made symmetric. The center M of the circumferential surface radius r is located in the center plane 9 of the disk 3.1. The yarn 2 loops about the circumferential surface 11 over the entire disk height h. The yarn 2 advances onto circumferential surface 11 over an inlet edge 8. On the underside of the disk, the yarn 2 leaves the circumferential surface 11 over an outlet edge 10. In this connection, the inlet angle $\alpha$ of yarn 2 on the inlet side and the outlet angle $\alpha$ on the outlet side of disk 3.1 are identical.

In accordance with the invention, the circumferential surface radius r is at least 35 times as large as the yarn diameter $d_F$ of the twisted yarn. The yarn diameter $d_F$ can be calculated from the yarn denier, crimp, and density of the yarn material. Thus, it becomes possible to prepare an optimal layout of the friction disks for each yarn diameter. For example, for a polyester yarn with a denier of 335 dtex, the yarn diameter $d_F$ can amount to 0.198 mm. In accordance with the invention, it follows therefrom that the radius r of the circumferential surface should be at least 8 mm. In a further example of a polyamide yarn with a denier of 110 dtex, the calculated yarn diameter $d_F$ is 0.123 mm. In accordance with the invention, the disks of the false twist device must have on their circumferential surface a radius of, for example, 5 mm, so as to maintain the factor 35.

Figure 3:
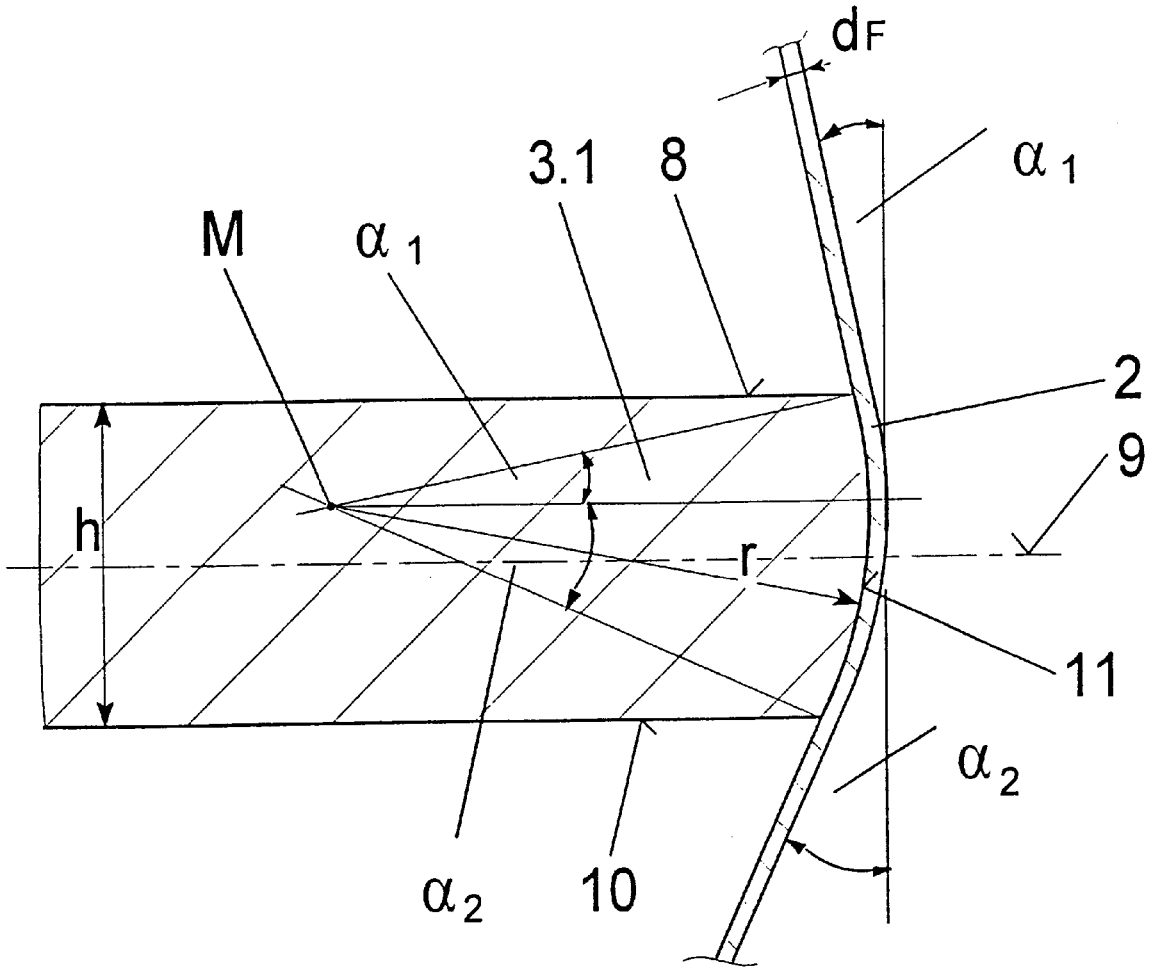

FIG. 3 shows a further embodiment of a disk as could be used in the false twist device of FIG. 1. In case of the disk of FIG. 3, the center M of the circumferential surface radius r is not located in the center plane 9. The circumferential surface 11 within the disk height h is made asymmetrical. In particular, with the use of disk materials with high coefficients of friction, the twist imparted to the yarn results in that the inlet angle and the outlet angle of the yarn are unequal. As a rule, the inlet angle $\alpha$ on the inlet side of the disk is smaller than the outlet angle $\alpha_2$ on the outlet side. To obtain a uniform contact of the yarn on the circumferential surface 11 of the disk over the entire height h of the disk, it is necessary that the center be relocated in accordance with the angle distribution in the center plane 9. The total looping angle of the yarn on disk 3.1 results from the sum of the angles $\alpha_1$ and $\alpha_2$.

The heat- and wear-resistant configuration of the false twist device according to the invention, as well as the reduction of the yarn tension loss by large radii of curvature on the circumferential surfaces of the disks, permit texturing yarns with great stability at a high production speed. The invention is not limited only to the foregoing disk materials, such as elastomer or rubber. Naturally, the disks of the false twist device may also be made of metal or ceramic.

What is claimed is:

1. A false twist device for imparting twist to an advancing multifilament yarn in a false twist texturing machine so as to form a twisted yarn having a given diameter, comprising at least three sets of disks that are each mounted on an axle for rotation in the same direction, with the axles being parallel to each other and arranged at the corners of an equilateral polygon and with the disks having peripheries which overlap in the center of the polygon so as to form a helical winding yarn path, and with the discs each comprising parallel inlet and outlet surfaces, and a circumferential surface defining the periphery thereof and extending between the inlet and outlet surfaces, and with said circumferential surface being formed by the surface of a sphere or torus having a radius of curvature of uniform length along the entire distance between the inlet and outlet surfaces and of a magnitude of at least 35 times the diameter of the twisted yarn.

2. The false twist device as defined in claim 1 wherein the inlet and outlet surfaces of each disk define a center plane lying equidistant therebetween, and wherein the center of the radius of curvature of the circumferential surface lies in said center plane.

3. The false twist device as defined in claim 1 wherein the inlet and outlet surfaces of each disk define a center plane lying equidistant therebetween, and wherein the center of the radius of curvature of the circumferential surface lies outside the center plane of each disk.

4. The false twist device as defined in claim 3 wherein the center of the radius of curvature of the circumferential surface lies between the center plane and the inlet surface.

5. The false twist device as defined in claim 1 wherein the circumferential surface of each of said disks comprises a heat resistant elastomer with a resistance to heat greater than 100° C.

6. The false twist device as defined in claim 1 wherein the circumferential surface of each of said disks comprises a heat resistant rubber.

7. A false twist device for imparting twist to an advancing multifilament yarn in a false twist texturing machine so as to form a twisted yarn having a given diameter, comprising at least three sets of disks that are each mounted on an axle for rotation in the same direction, with the axles being parallel to each other and arranged at the corners of an equilateral polygon and with the disks having peripheries which overlap in the center of the polygon so as to form a helical winding yarn path, and with the discs each comprising parallel inlet and outlet surfaces, and a circumferential surface defining the periphery thereof and extending between the inlet and outlet surfaces, and with said circumferential surface being formed by the surface of a sphere or torus having a radius of curvature of a magnitude of at least 35 times the diameter of the twisted yarn, wherein the inlet and outlet surfaces of each disk define a center plane lying equidistant therebetween, and wherein the center of the radius of curvature of the circumferential surface lies outside the center plane.

8. The false twist device as defined in claim 7 wherein the center of the radius of curvature of the circumferential surface lies between the center plane and the inlet surface.

9. A method for imparting twist to an advancing multifilament yarn in a false twist texturing machine comprising the steps of providing a false twist device which comprises at least three sets of disks that are each mounted on an axle for rotation in the same direction, with the axles being parallel to each other and arranged at the corners of an equilateral polygon and with the disks having peripheries which overlap in the center of the polygon so as to form a helical winding yarn path, and with the discs each comprising parallel inlet and outlet surfaces, and a circumferential surface defining the periphery thereof and extending between the inlet and outlet surfaces, and with said circumferential surface being formed by the surface of a sphere or torus having a radius of curvature of uniform length along the entire distance between the inlet and outlet surfaces, advancing the multifilament yarn through the false twist device so as to impart twist to the yarn and cause the twisted yarn to have a given diameter, and wherein the radius of curvature of the circumferential surface of each disk is of a magnitude which is at least 35 times the twisted diameter.

10. The method as defined in claim 9 wherein the multifilament yarn has a denier greater than 170 dtex.

11. The method as defined in claim 9 wherein the multifilament yarn has a denier less than 170 dtex and the radius of curvature of the circumferential surface of each disk is greater than 40 times the given diameter.

12. The method as defined in claim 9 wherein the inlet and outlet surfaces of each disk define a center plane lying equidistant therebetween, and wherein the center of the radius of curvature of the circumferential surface of each disk lies in said center plane.

13. The method as defined in claim 9 wherein the inlet and outlet surfaces of each disk define a center plane lying equidistant therebetween, and wherein the center of the radius of curvature of the circumferential surface of each disk lies outside said center plane.

* * * * *